US011678123B2

(12) United States Patent
Otto et al.

(10) Patent No.: US 11,678,123 B2
(45) Date of Patent: Jun. 13, 2023

(54) ELECTROMAGNETIC ACTUATOR FOR A SPEAKER OR A SOUND TRANSDUCER WITH A HIGH-STRENGTH METAL CONNECTION BETWEEN THE VOICE COIL AND THE MAGNET SYSTEM

(71) Applicant: Sound Solutions International Co., Ltd., Beijing (CN)

(72) Inventors: Gustav Otto, Vienna (AT); Markus Trampert, Vienna (AT); Stefan Gebhardt, Vienna (AT); Andreas Hintennach, Vienna (AT); Manuel Mefleh, Vienna (AT); Ernst Tomas, Strasshof an der Nordbahn (AT)

(73) Assignee: Sound Solutions International Co., Ltd., Beijing (CN)

( * ) Notice: Subject to any disclaimer, the term of this patent is extended or adjusted under 35 U.S.C. 154(b) by 0 days.

(21) Appl. No.: 17/325,046

(22) Filed: May 19, 2021

(65) Prior Publication Data

US 2021/0368277 A1 Nov. 25, 2021

(30) Foreign Application Priority Data

May 20, 2020 (AT) ..... A 50442/2020

(51) Int. Cl.
*H04R 9/06* (2006.01)
*H04R 9/04* (2006.01)
*H04R 9/02* (2006.01)

(52) U.S. Cl.
CPC ..... *H04R 9/06* (2013.01); *H04R 9/025* (2013.01); *H04R 9/046* (2013.01)

(58) Field of Classification Search
CPC ..... H04R 9/06; H04R 9/025; H04R 9/046; H04R 9/041; H04R 9/066; H04R 31/00;
(Continued)

(56) References Cited

U.S. PATENT DOCUMENTS 5,828,767 A 10/1998 Button
6,377,145 B1 4/2002 Kumagai
(Continued)

FOREIGN PATENT DOCUMENTS

CN 1294832 A * 5/2001 ..... H04R 7/16
CN 1294832 A 9/2001
(Continued)

OTHER PUBLICATIONS

Office Action and Search Report for counterpart application CN 202010702391.7, with English machine translation dated Jan. 13, 2022.
(Continued)

*Primary Examiner* — Angelica M McKinney
(74) *Attorney, Agent, or Firm* — Dykema Gossett PLLC

(57) ABSTRACT

An electrodynamic actuator for a speaker or an electrodynamic acoustic transducer in general is disclosed, which comprises at least one voice coil, a magnet system and an arm arrangement of a plurality of arms connecting the at least one voice coil and the magnet system or at least a movable part thereof so that a relative movement between these parts is allowed. The arms are made of metal with a fatigue strength of at least 370 N/mm$^2$ or an ultimate tensile strength of at least 1100 N/mm$^2$.

25 Claims, 8 Drawing Sheets

(58) Field of Classification Search
CPC ..... H04R 2209/024; H04R 2209/041; H04R 2231/003; H04R 2307/025; H04R 2307/027
See application file for complete search history.

(56) References Cited

U.S. PATENT DOCUMENTS

| | | | | |
|---|---|---|---|---|
| 7,550,880 | B1 | 6/2009 | Pusl | |
| 2003/0036364 | A1 | 2/2003 | Chung | |
| 2003/0124990 | A1 | 7/2003 | Kawano et al. | |
| 2003/0227225 | A1* | 12/2003 | Kaneda | H02K 33/18 310/81 |
| 2004/0001603 | A1 | 1/2004 | Sahyoun | |
| 2007/0164616 | A1 | 7/2007 | Kuwabara et al. | |
| 2007/0291976 | A1 | 12/2007 | Kajiwara | |
| 2009/0174510 | A1 | 7/2009 | Kim | |
| 2010/0189284 | A1 | 7/2010 | Kuze et al. | |
| 2010/0189304 | A1 | 7/2010 | Ueda | |
| 2014/0103751 | A1 | 4/2014 | Furukawa et al. | |
| 2014/0241564 | A1 | 8/2014 | Kang et al. | |
| 2014/0254191 | A1 | 9/2014 | Yasuike et al. | |
| 2017/0280216 | A1 | 9/2017 | Lee et al. | |
| 2018/0279052 | A1 | 9/2018 | Reining | |
| 2019/0092231 | A1 | 3/2019 | Lee | |
| 2019/0208300 | A1 | 7/2019 | Lee et al. | |
| 2019/0215603 | A1 | 7/2019 | Timothy et al. | |
| 2020/0045466 | A1* | 2/2020 | Song | H04R 9/043 |
| 2020/0107132 | A1 | 4/2020 | Concessi | |
| 2021/0099063 | A1 | 4/2021 | Wasenczuk | |

FOREIGN PATENT DOCUMENTS

| | | | |
|---|---|---|---|
| CN | 1347628 | A | 1/2002 |
| CN | 101007305 | A | 8/2007 |
| CN | 101983514 | A | 2/2011 |
| CN | 103731003 | A | 4/2014 |
| CN | 107750040 | A | 3/2018 |
| CN | 108668198 | A | 10/2018 |
| CN | 207968942 | U | 10/2018 |
| EP | 1310860 | A1 | 5/2003 |
| EP | 3226069 | A2 | 10/2017 |
| EP | 3229063 | A1 | 10/2017 |
| EP | 3229272 | A1 | 10/2017 |
| JP | 2003211087 | A | 7/2003 |
| KR | 20110004291 | U | 4/2011 |
| WO | 0047013 | A1 | 8/2000 |
| WO | 0067523 | A2 | 11/2000 |
| WO | 03067923 | A2 | 8/2003 |
| WO | 2009133986 | A1 | 11/2009 |
| WO | 2011104659 | A2 | 9/2011 |
| WO | 2012032124 | A1 | 3/2012 |
| WO | 2012129247 | A2 | 9/2012 |
| WO | 2014073448 | A1 | 5/2014 |

OTHER PUBLICATIONS

Office Action and Search Report for counterpart application CN 202010702368.8, with English machine translation dated Jan. 13, 2022.
Austrian Patent Office; First Office Action issued in application No. A 50643/2019 Action dated Nov. 6, 2019.
Austrian Patent Office; First Office Action issued in application No. A 50013/2020. Action dated Sep. 29, 2020.
Austrian Patent Office; First Office Action issued in application No. A 50441/2020. Action dated Feb. 17, 2021.
Austrian Patent Office; First Office Action issued in counterpart application No. A 50442/2020. Action dated Feb. 17, 2021.
State Intellectual Property Office PRC. First Office Action and Search Report issued for counterpart Chinese application No. 202010702368.8. dated Jun. 25, 2021.
State Intellectual Property Office PRC. First Office Action and Search Report issued for counterpart Chinese application No. 202010702391.7. dated Jun. 28, 2021.
Hu Xiao-Fei et al. Development and Application Prospects of the Electromagnetic Brake. vol. 47, No. 4. Beijing Research Institute of Precise Mechanical and Electronic Control Equipment.
Zhou Wen-Jie et al. Performance Analysis of Three Type Flexure Bearings for Linear Compressors. vol. 43, No. 1. Journal of Nanjing University of Aeronautics & Astronautics.
USPTO. Non-final Office Action issued in counterpart U.S. Appl. No. 16/931,372. dated Jul. 22, 2021.
The Engineering ToolBox, Steels—Endurance Limits and Fatigue Stress, 2011 online. Available at https://www.engineeringtoolbox.com/steel-endurance-limit-d_1781.html Accessed Jan. 9, 2022 (Year: 2011).
USPTO. Non-final Office Action issued in counterpart U.S. Appl. No. 16/931,355 dated Oct. 24, 2022.
USPTO. Office Action issued in U.S. Appl. No. 17/325,032 dated Nov. 1, 2022.
USPTO. Final Office Action issued in U.S. Appl. No. 16/931,355 dated Feb. 24, 2023.

* cited by examiner

ELECTROMAGNETIC ACTUATOR FOR A SPEAKER OR A SOUND TRANSDUCER WITH A HIGH-STRENGTH METAL CONNECTION BETWEEN THE VOICE COIL AND THE MAGNET SYSTEM

PRIORITY

This patent application claims priority from Austrian Patent Application No. A50442/2020, filed on May 20, 2020, the disclosure of which is incorporated herein, in its entirety, by reference

BACKGROUND

The invention relates to an electrodynamic actuator, which is designed to be connected to a backside of a plate like structure or membrane opposite to a sound emanating surface of the plate like structure or the membrane. The electrodynamic actuator comprises at least one voice coil, which has an electrical conductor in the shape of loops running around a coil axis in a loop section and a magnet system being designed to generate a magnetic field transverse to the conductor in the loop section. Furthermore, the electrodynamic actuator comprises an arm arrangement with a plurality of arms (or legs or levers). These arms connect the at least one voice coil and a) the magnet system and allow a relative movement between the voice coil and said magnet system in an excursion direction parallel to the coil axis or b) a movable part of the magnet system and allow a relative movement between the voice coil and said movable part of the magnet system in an excursion direction parallel to the coil axis. The invention furthermore relates to a speaker, which comprises an electrodynamic actuator of the above kind and a membrane, which is fixed to the at least one coil and to the magnet system. In addition, the invention relates to an electrodynamic (acoustic) transducer, which comprises a plate like structure with a sound emanating surface and a backside opposite to the sound emanating surface. The electrodynamic transducer additionally comprises an electrodynamic actuator of the above kind, which is connected to the plate like structure on said backside. In particular, the plate like structure can be embodied as a display. In this way, the electrodynamic actuator together with the display forms an output device (for both audio and video data).

An electrodynamic actuator of the kind above is generally known. An electrical sound signal fed to the voice coil generates a force in the magnetic field of the magnet system and causes a movement between the coil arrangement and the magnet system or at least its movable part. In turn the membrane or plate like structure is deflected or moves according to the electric sound signal. As a consequence, sound corresponding to the electric sound signal is emanated from the sound emanating surface of the plate like structure or the membrane.

The ever increasing output power in relation to the size of the electrodynamic actuator puts comparably high demands on the arm arrangement because high excursions in relation to the size of the electrodynamic actuator cause comparably high bending stress in the arms of the arm arrangement. On the other hand, the arms shall cause a mechanical resistance (i.e. a force counteracting the force generated by the electrical sound signal) just as low as possible so that the efficiency of the electrodynamic actuator is kept high. Usually, synthetic materials, the characteristics of which can be set in a wide range, are used for this application. In case that the arms are additionally used for an electrical connection of the coil to fixed terminals, often flexible printed circuit material (polyimide layer(s) with copper layer(s)) is used for the arms. However, experience shows that usual synthetic materials and in particular the copper layer of a flexible printed circuit is prone to breakage in the long term coming from the mechanical stress caused by the comparably large excursions of the electrodynamic actuator.

SUMMARY OF THE INVENTION

Thus, it is an object of the invention to overcome the drawbacks of the prior art and to provide a better electrodynamic actuator, a better speaker, a better electrodynamic transducer and a better output device. In particular, the life time of the arm arrangement shall be increased without foiling the power and the efficiency of the electrodynamic actuator.

The inventive problem is solved by an electromagnetic actuator as defined in the opening paragraph, wherein the arms are made of a metal with a fatigue strength of at least 370 $N/mm^2$ or an ultimate tensile strength of at least 1100 $N/mm^2$.

Generally, the arms can be made of a single metal with a fatigue strength of at least 370 $N/mm^2$ or an ultimate tensile strength of at least 1100 $N/mm^2$. However, it is also possible, that the arms are made of a metal core with a fatigue strength of at least 370 $N/mm^2$ or an ultimate tensile strength of at least 1100 $N/mm^2$, which at least partly (or entirely) is coated with a coating structure having at least one coating metal layer consisting of a different material than the metal core.

The invention furthermore relates to a speaker, which comprises an electrodynamic actuator of the above kind and a membrane, which is fixed to the at least one coil and to the magnet system. In addition, the invention relates to an electrodynamic (acoustic) transducer, which comprises a plate like structure with a sound emanating surface and a backside opposite to the sound emanating surface. The electrodynamic transducer additionally comprises an electrodynamic actuator of the above kind which is connected to the plate like structure on said backside. For this reason, beneficially the at least one voice coil or the magnet system of the electrodynamic actuator comprises a flat mounting surface, which is intended to be connected to the backside of the plate like structure opposite to a sound emanating surface of the plate like structure, wherein said backside is oriented perpendicularly to the coil axis. In particular, the plate like structure can be embodied as a display. In this way, the electrodynamic actuator together with the display forms an output device (for both audio and video data).

By the above measures, the lifetime of the arm arrangement can be extended without foiling the power and the efficiency of the electrodynamic actuator. Although a skilled in the art in the past commonly came to the conclusion that metals with a fatigue strength of at least 370 $N/mm^2$ or an ultimate tensile strength of at least 1100 $N/mm^2$ put way to much mechanical resistance on a relative movement between the coil arrangement and the magnet system or its movable part, it surprisingly turned out that arms made of very thin metal (metal foils) have superior characteristics in the given application and beat the commonly used synthetic materials. Beneficially, the height of the cross section of the arm and in particular the metal core is in a range of 10 to 100 μm. Further on it is beneficial if a width of the cross section of the arm and in particular the metal core is in a range of 200 to 800 μm. Despite of their low thickness, these metals (metal foils) are very durable and because of their low thickness generate comparably low mechanical resistance.

Beneficially, the arm and in particular the metal core can be made of or comprise steel, brass, bronze, molybdenum or tungsten. It is advantageous, if the arm and in particular the metal core is made of a stainless steel, and it is very advantageous if the arm and in particular the metal core is made of a cold-rolled stainless steel with a fatigue strength in a range of 370 to 670 $N/mm^2$ or an ultimate tensile strength in a range of 1100 to 2000 $N/mm^2$. Beneficially, austenitic stainless steel can be used for the arm and in particular the metal core, in particular stainless steel 1.4404. Austenitic stainless steels have a high share of austenite and as such are non-ferromagnetic or low-ferromagnetic. Accordingly no or just low (unwanted) forces are induced into the arms when they move in the magnetic field in the air gap of the magnet system. Such forces could shift the (dynamic) idle position of the electrodynamic actuator and deteriorate the characteristics of the electrodynamic actuator. Moreover, austenitic stainless steel does not or does not substantially magnetically bridge the air gap of the magnet system. In other words, the arms do not form magnetic short circuits in the magnet system. Furthermore, stainless steel, in addition to its characteristics presented before, provides the advantage that it is resistant against oxidation.

The "fatigue strength" (or endurance limit or fatigue limit), generally is the stress level below which an infinite number of loading cycles can be applied to a material without causing fatigue failure or inadmissible deformation. Above this stress level, fatigue failure or inadmissible deformation occurs in some point of time.

The "ultimate tensile strength" is the maximum stress that a material can withstand while being stretched or pulled before breaking (in case of a single load). The ultimate tensile strength, as a rule of thumb, is about three times the fatigue strength for metals.

However, using a metal for the arm arrangement has a further advantage. Beneficially, at least some of the arms of the arm arrangement can be electrically connected to the at least one voice coil. Accordingly, the arms can provide the function of electrically connecting the voice coil with fixed terminals, which in turn are used to connect the electrodynamic actuator to further circuitry, for example to a power amplifier. In that, the arms can draw the electrical sound signals and/or feedback signals, which can be used to measure characteristics of the electrodynamic actuator and further on to control the behavior of the electrodynamic actuator. By the proposed measures, the drawbacks of flexible printed circuit material are overcome.

It is very advantageous, if the material of the at least one coating metal layer has a higher or better electrical conductivity than the material of the metal core, but a lower or worse bending fatigue strength or ultimate tensile strength. That means that the material of the metal core can be chosen in view of good mechanical properties, whereas the at least one coating metal layer can be chosen in view of good electrical characteristics. Accordingly, the arm can be designed in a way that the metal core mainly takes the mechanical load, whereas the at least one coating metal layer mainly takes the electrical load or mainly has the electrical function. Beneficially, the at least one coating metal layer can comprise or consist of copper, silver, gold or aluminum. These materials have very good electrical characteristics, i.e. a very good electrical conductivity.

Beneficially, the thickness of the at least one coating metal layer is in a range of 0.5 to 10 μm, wherein the thickness of the at least one coating metal layer is its extension in a direction parallel to the coil axis in case that a contacting area to the metal core lies in a plane perpendicular to the coil axis and its extension in a direction perpendicular to the coil axis in case that a contacting area to the metal core lies in a plane parallel to the coil axis. Hence, a low ohmic resistance can be obtained without increasing the weight of the arms much. The coating structure may cover the metal core on one or more sides. In particular the metal core can be covered as a whole.

In a very advantageous embodiment of the electrodynamic actuator, the bending stress within the metal core is below its fatigue strength whereas the bending stress within the at least one coating metal layer is above its fatigue strength, or the bending stress within the metal core is below its ultimate tensile strength whereas the bending stress within the at least one coating metal layer is above its bending ultimate tensile strength when the excursion of the voice coil relative to the magnet system in a direction parallel to the coil axis (i.e. its amplitude) reaches its nominal maximum of the electrodynamic actuator or is above 0.4 mm with respect to the idle position of the voice coil.

In other words this means that the at least one coating metal layer will break when the electrodynamic actuator is operated or will break by default or by design. Accordingly, cracks or grooves occur in the at least one coating metal layer over time. One would come to the conclusion that the ohmic resistance for this reason would rise up to a level that the performance of the electrodynamic actuator or the speaker is substantially deteriorated or even inacceptable. Surprisingly, the cracks or grooves do not have much influence on the function of the arms as investigations have been shown. The reason is that a current, which usually flows through the at least one coating metal layer locally changes over to the metal core, which then draws the current. So the currents are not interrupted as it is the case if a flexible printed circuit is used, but they have just a slightly higher ohmic resistance for a short distance. In turn this configuration provides both an outstanding mechanical resistance based on the characteristics of the material of the metal core and outstanding electrical conductivity based on the characteristics of the first coating metal layer.

The performance of the arms is based on the insight, that the choices of the materials for the metal core and for the at least one coating metal layer basically do not depend on each other. The mechanical strength of the at least one coating metal layer does not depend on the load which the metal core carries, and the same is true for the electrical conductivity.

Although cracks or grooves are accepted in the at least one coating metal layer, the overall electrical conductivity is much better than it is if just the material of the metal core is used for the arms (what would be the common approach of avoiding breakage). At the same time, the overall mechanical performance is much better than if just the material of the at least one coating metal layer would be used for the arms (what would be the common approach of providing best electrical conductivity). So the overall performance of the proposed configuration goes beyond that what a skilled in the art had expected.

In general, it is of advantage if the coating structure comprises an outer coating layer made of a polymer (e.g. a thermoplastics, a thermosetting plastic, an elastomer, silicone or rubber), which at least partly (and in particular entirely) covers the at least one coating metal layer. This is particularly true for the above configuration where the at least one coating metal layer breaks by design. In this way, not only oxidation is avoided by the outer coating layer, but additionally chipping or peeling of the at least one coating metal layer can be hindered, or at least parts of the at least one coating metal layer chipped or peeled off can be hold back. In other words, the outer coating layer avoids that parts of the at least one coating metal layer spread in an uncontrolled manner what could cause short circuits and malfunction of the electrodynamic actuator and of the device, which the electrodynamic actuator is built into.

The proposed measures in particular apply to "micro" electrodynamic actuators. The proposed measures also apply to speakers in general and particularly to micro speakers, whose membrane area is smaller than 600 $mm^2$ and/or whose back volume is in a range from 200 $mm^3$ to 2 $cm^3$. Such micro speakers are used in all kind of mobile devices such as mobile phones, mobile music devices, laptops and/or in headphones. It should be noted at this point, that a micro speaker does not necessarily comprise its own back volume but can use a space of a device, which the speaker is built into, as a back volume. That means, the speaker does not necessarily comprise its own (closed) housing but can comprise just an (open) frame. The back volume of the devices, which such speakers are built into, typically is smaller than 10 $cm^3$.

Moreover, a diameter of a metal core of the electrical conductor of the at least one voice coil of "micro" electrodynamic actuators beneficially is ≤110 nm. The electrical conductor can also comprise a (electrically insulating) coating on the metal core as the case may be.

Generally an "electrodynamic actuator" transforms electrical power into movement and force. An electrodynamic actuator together with a membrane forms a "speaker". An electrodynamic actuator together with a plate forms an "electrodynamic (acoustic) transducer". A special embodiment of a plate is a display. In this case, an electrodynamic actuator together with a display forms an "output device" (for both audio and video data). Generally, a speaker, an electrodynamic transducer and an output device transforms electrical power into sound.

It should be noted that sound can also emanate from the backside of the plate like structure and the membrane. However, this backside usually faces an interior space of a device (e.g. a mobile phone), which the speaker or output device is built into. Hence, the plate like structure or membrane may be considered to have the main sound emanating surface and a secondary sound emanating surface (i.e. said backside). Sound waves emanated by the main sound emanating surface directly reach the user's ear, whereas sound waves emanated by the a secondary sound emanating surface do not directly reach the user's ear, but only indirectly via reflection or excitation of other surfaces of a housing the device, which the speaker or output device is built into.

A "movable part of the magnet system" in the context of the disclosure means a part of the magnet system which can move relatively to the at least one voice coil. Generally, a magnet system may have a fixed part, which is fixedly mounted to the voice coil or fixedly mounted in relation to the voice coil, and a movable part. It is also possible, that the whole magnet system is movable in relation to the at least one voice coil. In this case the movable part of the magnet system is the magnet system, and there is no fixed part.

The magnet system and/or the voice coil may be connected to or may be part of a housing or frame, and the arms can be connected to that housing or frame. So, the arms are not necessarily directly connected to the voice coil and the movable part of the magnet system, but can be connected thereto indirectly as well.

The arrangement of a plurality of arms can be seen as a spring arrangement in case that the electrodynamic actuator is connected to a backside of a plate like structure and can be seen as a suspension system in case that the electrodynamic actuator is connected to a backside of a membrane.

Further details and advantages of the audio transducer of the disclosed kind will become apparent in the following description and the accompanying drawings.

In an advantageous embodiment of the electrodynamic actuator, the coating structure comprises at least two coating metal layers, wherein a first coating metal layer comprises copper, silver, gold or aluminum and wherein a different second coating metal layer, which is located between the metal core and the first coating metal layer, comprises nickel, titanium or chromium. It is particularly advantageous, if the first coating metal layer and the second coating metal layer are chosen from the pairs of Cu/Ni, Au/Ni, Ag/Ni, Al/Ti, Al/Cr, wherein the first cited metal refers to the first coating metal layer and the second cited metal refers to the second coating metal layer and wherein said metals are the main components of the respective coating metal layers or the coating metal layers consist of the respective metals. In this way, the second coating metal layer can be used as a bonding agent or a bonding intermediate layer for the first coating metal layer so that a good adhesive strength can be obtained.

Beneficially, the cross section of the arm and in particular the metal core is rectangular wherein a ratio between the width of the cross section, which is its extension in a direction perpendicular to the coil axis, divided by the height of the cross section, which is its extension in a direction parallel to the coil axis, is above 3.0. These measures contribute to a comparably low stiffness of the arms in the excursion direction of the electrodynamic actuator and a comparably high stiffness of the arms in a lateral direction (perpendicular to the excursion direction) in a range, which is favorable in view of high power and high efficiency of the electrodynamic actuator. Moreover, a rocking tendency can be kept low. "Rocking" generally is an unwanted rotation between the coil arrangement and the magnet system or its movable part around an axis perpendicular to the coil axis.

Advantageously, the width and/or height of the cross section of the arm and in particular the metal core varies over the length of the arms. In this way, the shape, into which an arm is transformed when it is deflected, can be controlled or influenced. Moreover, unwanted load peaks can be mitigated.

Beneficially, the cross section of the arm and in particular the metal core has rounded corners with a radius of at least 3 μm or chamfers, wherein the smallest length of a side of a rectangular triangle defining the chamfer is at least 3 μm (e.g. a chamfer 45°×3 μm). In this way, a good adhesive strength for the at least one coating metal layer can be obtained even in the corners of the metal core.

Beneficially, the arms are shaped like a bow, like a meander or L-shaped when viewed into a direction parallel to the coil axis. In this way, the arms can be made comparably soft in a direction parallel to the coil axis, i.e. in the excursion direction. Accordingly, efficiency and acoustic power of the electrodynamic actuator are comparably high. It should be noted at this point that the meander or bow is not necessarily "round", but may also comprise, be made up or be approximated by straight segments. Accordingly, the straight segments can be concatenated by corners, or there can be arcs between the straight segments.

In a very advantageous embodiment of the electrodynamic actuator, the arms are shaped like a bow or L-shaped when viewed into a direction parallel to the coil axis, wherein at least a contacting pad of the arms is arranged within the bow or within the corner of the L-shape. In yet another very advantageous embodiment of the electrodynamic actuator, the arms are shaped like a meander when viewed into a direction parallel to the coil axis, wherein the meander has two bows at most and wherein at least one contacting pad of the arms is arranged within the at least one bow. In particular, a distance between the bow or corner and the at least one contacting pad is less than 0.2 mm. In this way, the area for a contacting pad can be made relatively large so that the coil arrangement can be connected to the arm reliably (e.g. by soldering, welding or gluing), although just little space is needed in total for the connection of the magnet system and the coil arrangement. In other words, the contacting pad is no cause for an increased air gap between the magnet system and the coil arrangement, and hence efficiency and power of the electrodynamic actuator are comparably high.

Beneficially, the coating structure is arranged on the metal core over a length of at least 90% of the longitudinal extension of an arm. In this way, uniform characteristics for nearly the whole arm can be obtained.

Advantageously, a ratio of a stiffness of the arm arrangement to a stiffness of the membrane in direction of the coil axis is below 2.7. Alternatively or in addition it is of advantage if a ratio of a stiffness of the arm arrangement to a stiffness of the membrane in direction transverse to the coil axis is below 5.0. These measures contribute to a comparably low stiffness of the arms in excursion direction of the electrodynamic actuator and a comparably high stiffness of the arms in a lateral direction (perpendicular to the excursion direction) in a range which is favorable in view of high power and high efficiency of the electrodynamic actuator as well as low rocking tendency.

Beneficially, an average sound pressure level of the speaker or the electrodynamic transducer (or the output device) measured in an orthogonal distance of 10 cm from the sound emanating surface is at least 50 dB_SPL in a frequency range from 100 Hz to 15 kHz. "Average sound pressure level $SPL_{AVG}$" in general means the integral of the sound pressure level SPL over a particular frequency range divided by said frequency range. In the above context, in detail the ratio between the sound pressure level SPL integrated over a frequency range from f=100 Hz to f=15 kHz and the frequency range from f=100 Hz to f=15 kHz is meant. In particular, the above average sound pressure level is measured at 1 W electrical power more particularly at the nominal impedance. The unit "dB_SPL" generally denotes the sound pressure level relative to the threshold of audibility, which is 20 μPa.

BRIEF DESCRIPTION OF THE DRAWINGS

These and other aspects, features, details, utilities, and advantages of the invention will become more fully apparent from the following detailed description, appended claims, and accompanying drawings, wherein the drawings illustrate features in accordance with exemplary embodiments of the invention, and wherein:

Like reference numbers refer to like or equivalent parts in the several views.

DETAILED DESCRIPTION OF EMBODIMENTS

Figure 1:
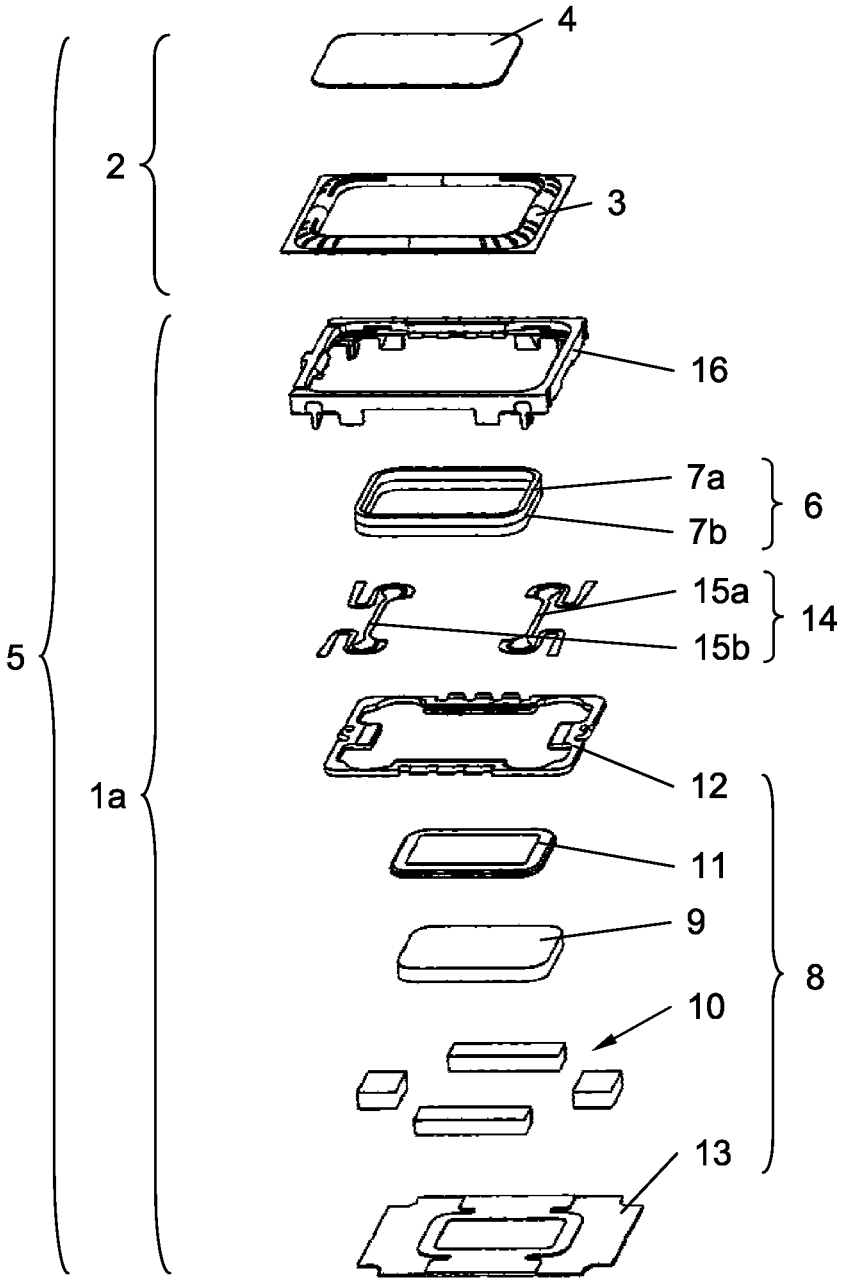
FIG. 1 shows an example of a speaker with an electromagnetic actuator in exploded view.

Various embodiments are described herein to various apparatuses. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It must be noted that, as used in this specification and the appended claims, the singular forms "a," "an" and "the" include plural referents unless the content clearly dictates otherwise.

The terms "first," "second," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

All directional references (e.g., "plus", "minus", "upper", "lower", "upward", "downward", "left", "right", "leftward", "rightward", "front", "rear", "top", "bottom", "over", "under", "above", "below", "vertical", "horizontal", "clockwise", and "counterclockwise") are only used for identification purposes to aid the reader's understanding of the present disclosure, and do not create limitations, particularly as to the position, orientation, or use of the any aspect of the disclosure. It is to be understood that the terms so used are interchangeable under appropriate circumstances such that the embodiments of the invention described herein are, for example, capable of operation in other orientations than those illustrated or otherwise described herein.

As used herein, the phrased "configured to," "configured for," and similar phrases indicate that the subject device, apparatus, or system is designed and/or constructed (e.g., through appropriate hardware, software, and/or components) to fulfill one or more specific object purposes, not that the subject device, apparatus, or system is merely capable of performing the object purpose.

Joinder references (e.g., "attached", "coupled", "connected", and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

All numbers expressing measurements and so forth used in the specification and claims are to be understood as being modified in all instances by the term "about" or "substantially", which particularly means a deviation of ±10% from a reference value.

Figure 2:
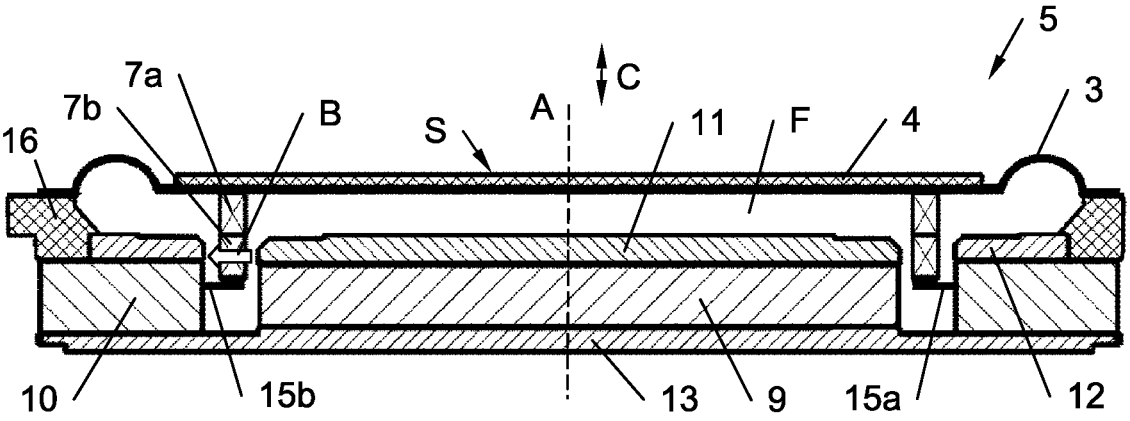
FIG. 2 shows the speaker of FIG. 1 in sectional view.
Figure 3:
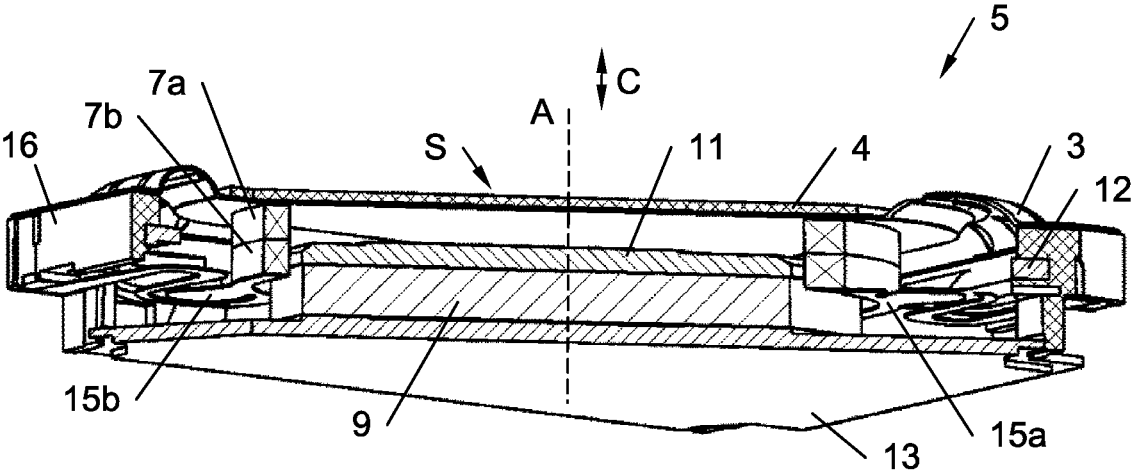
FIG. 3 shows an angular cross sectional view of the speaker of FIG. 1 from below.

An example of an electrodynamic actuator 1*a* is disclosed by use of the FIGS. 1 to 3. FIG. 1 shows an exploded view of the electrodynamic actuator 1*a*, FIG. 2 shows a cross sectional view of the electromagnetic actuator 1*a*, and FIG. 3 shows an angular cross sectional view of the electromagnetic actuator 1*a* from below.

Generally, the electromagnetic actuator 1*a* is designed to be connected to a backside of a plate like structure or membrane opposite to a sound emanating surface S of the plate like structure or the membrane. In the example shown in FIGS. 1 to 3, the electromagnetic actuator 1*a* is connected to a backside of a membrane 2. The membrane 2 in this example comprises a flexible membrane part 3 and a rigid membrane part 4 in the shape of a plate. However, the rigid membrane part 4 is just optionally and may be omitted. The electromagnetic actuator 1*a* together with the membrane 2 forms a speaker 5. So, in principle, FIG. 1 shows an exploded view of the speaker 5, FIG. 2 shows a cross sectional view of the speaker 5, and FIG. 3 shows an angular cross sectional view of the speaker 5 from below.

The electromagnetic actuator 1*a* has an annular coil arrangement 6, which in this example comprises a first voice coil 7*a* and a second voice coil 7*b* stacked above another and connected to each other by means of a glue layer. However, it is also possible that the electromagnetic actuator 1*a* comprises just one voice coil 7*a*. In any case, a voice coil 7*a*, 7*b* has an electrical conductor in the shape of loops running around a coil axis (or actuator axis) A in a loop section. For example, a diameter of a metal core of the electrical conductor of the voice coils 7*a*, 7*b* can be ≤110 μm and/or the electrical conductor can also comprise an (electrically insulating) coating on the metal core.

The electromagnetic actuator 1*a* furthermore comprises a magnet system 8, which in this example comprises a center magnet 9 and outer magnets 10 as well as a center top plate 11 from soft iron, an outer top plate 12 from soft iron and a bottom plate 13 from soft iron. The center magnet 9 is mounted to the bottom plate 13 and to the center top plate 11, and the outer magnets 10 are mounted to the bottom plate 13 and to the outer top plate 12. The magnet system 8 generally is designed to generate a magnetic field B transverse to a longitudinal direction of the electrical conductor of the annular coil arrangement 6 wound around the coil axis (or actuator axis) A in the loop section.

Moreover, the electromagnetic actuator 1*a* comprises an arm arrangement 14, which generally comprises of a plurality of arms (or legs or levers) connecting the coil arrangement 6 and the magnet system 8 and which allows a relative movement between the coil arrangement 6 and said magnet system 8 in an excursion direction C parallel to the coil axis A. In this example, the arm arrangement 14 comprises two arm sub arrangements 15*a*, 15*b* each having two arms.

Finally, the electromagnetic actuator 1*a* comprises a frame 16, to which the membrane 2 (in detail its flexible membrane part 3), the outer magnets 10, the outer top plate 12 and the bottom plate 13 are mounted. However, the frame 16 may be shaped different than depicted and may hold together a different set of parts. For example, it may be connected only to the outer magnets 10 or to the outer top plate 12. It should also be noted that the arm arrangement 14 does not necessarily connect the coil arrangement 6 and the magnet system 8 directly, but it may also connect them (indirectly) via the frame 16 for example.

Figure 4:
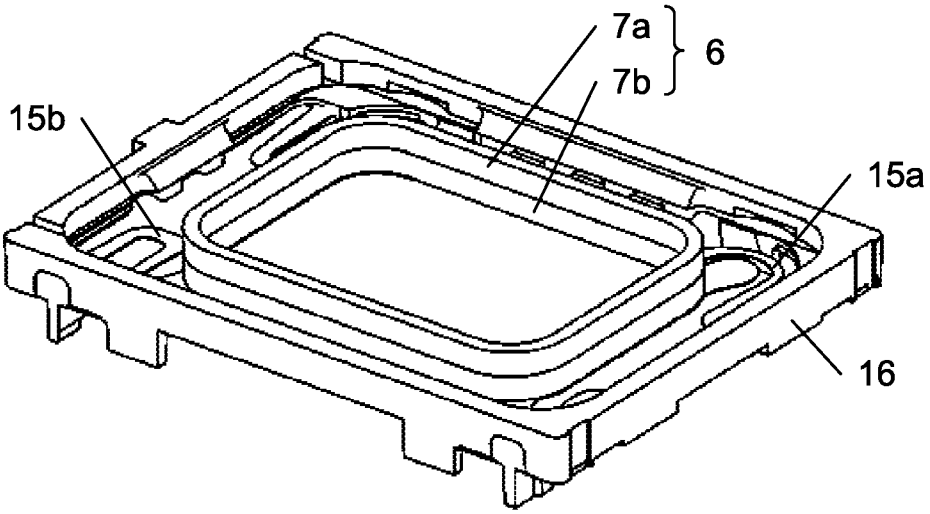
FIG. 4 shows the coil arrangement, the arm arrangement and the frame separated from the remaining parts of the speaker in angular view from above.
Figure 5:
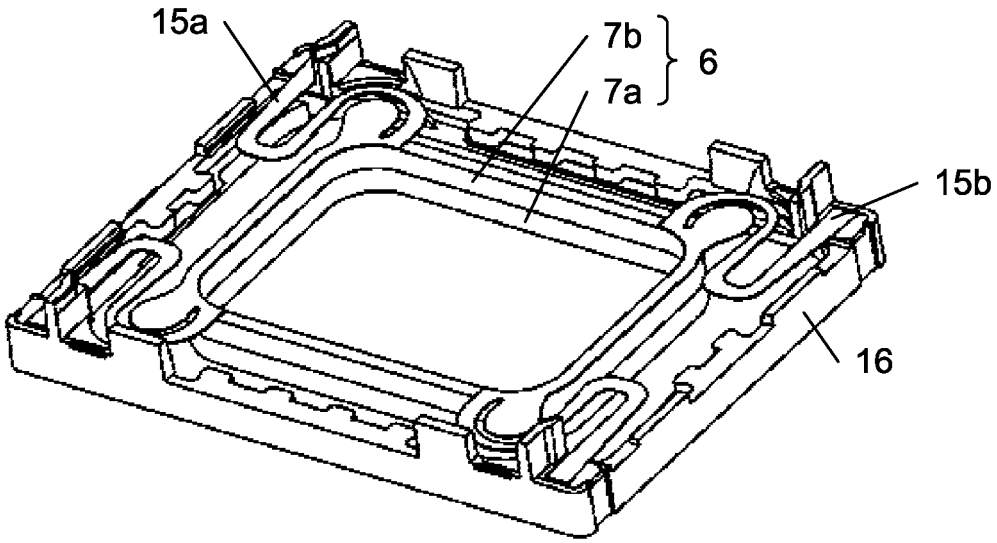
FIG. 5 shows the arrangement of FIG. 4 in angular view from below.

FIGS. 4 and 5 show the coil arrangement 6, the arm arrangement 14 and the frame 16 separated from the remaining parts of the speaker 5. FIG. 4 shows said arrangement in angular view from above, and FIG. 5 shows the arrangement in angular view from below, wherein the arrangement is flipped around its horizontal axis.

Figure 6:
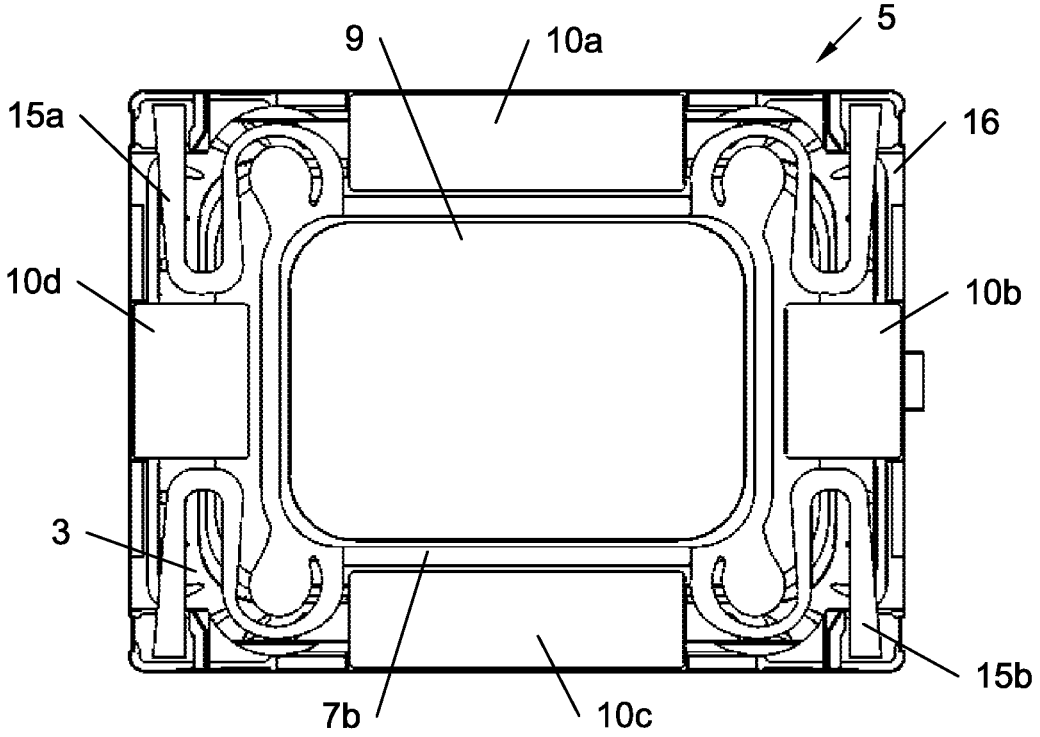
FIG. 6 shows a bottom view of the speaker with the bottom plate taken off.

Further on, FIG. 6 shows a bottom view of the speaker 5 with the bottom plate 13 taken off.

Figure 7:
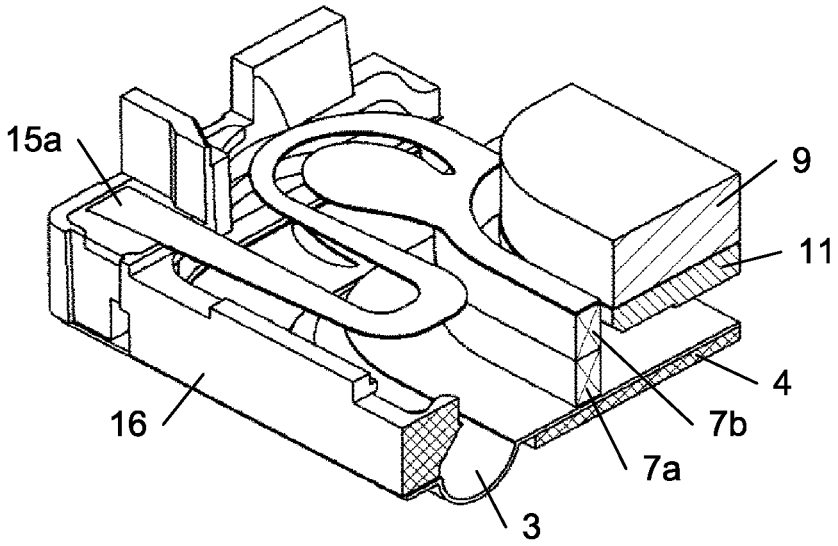
FIG. 7 shows a detailed angular view of the speaker from below with the bottom plate taken off and focused to the a first arm sub arrangement.

FIG. 7 shows a detailed angular view of the speaker 5 from below with the bottom plate 13 taken off and focused to the first arm sub arrangement 15*a*.

Figure 8:
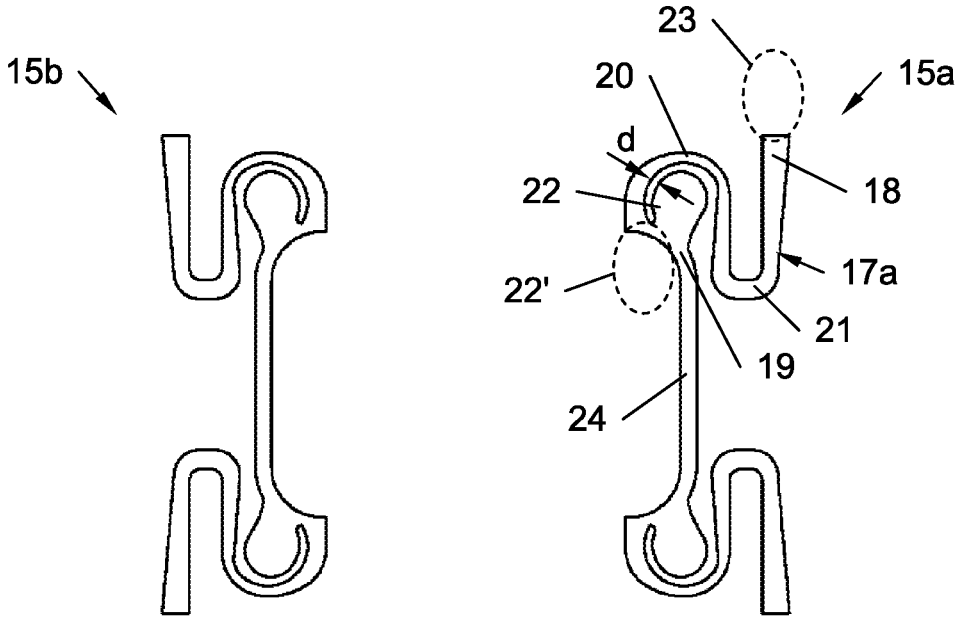
FIG. 8 shows the arm arrangement separated from the remaining parts of the speaker from above.

FIG. 8 shows the arm arrangement 14 separated from the remaining parts of the speaker 5 from above. The first arm sub arrangement 15*a* and the second arm sub arrangement 15*a* are identical, and the arms 17*a* of the arm sub arrangements 15*a*, 15*b* are identical as well. This is advantageous, but not mandatory, and the arm sub arrangements 15*a*, 15*b* and/or the arms 17*a* may differ from each other. However, because the arms 17*a* are identical in this example, just one of them is explained in detail. Nevertheless, the disclosure can be applied to the other arms equivalently.

The arm 17*a* comprises an outer connecting section 18 and an inner connecting section 19, wherein the outer connecting section 18 is used to connect the arm 17*a* to the frame 16 and the inner connecting section 19 is used to connect the arm 17*a* to the coil arrangement 6. Between the outer connecting section 18 and an inner connecting section 19 the arm 17*a* runs along its longitudinal extension. In the course of the arm 17*a*, in this example there are two bows 20, 21. That is why the arm 17*a* is shaped like a meander here when viewed into a direction parallel to the coil axis A. The meander has two bows 20, 21 in this example, but in principle the arm 17*a* can also have more than two bows 20, 21. Finally, the arm 17*a* comprises an optional inner contacting pad 22 to electrically connect the coil arrangement 6 to the arm 17*a*.

Generally, as said above, the arm 17*a* is used to mechanically connect the coil arrangement 6 and the magnet system 8. Accordingly, the outer connecting section 18 mechanically connects the arm 17*a* to the frame 17 and the inner connecting section 19 mechanically connects the arm 17*a* to the coil arrangement 6. However, in addition, the arm 17*a* can also be used to electrically connect the coil arrangement 6. In this case, the arm 17*a* has both a mechanical function and an electrical function. As said, the inner contacting pad 22 can be used to electrically connect the coil arrangement 6 to the arm 17*a*, but it is also possible to use the inner connecting section 19 for this reason. In this case, the inner connecting section 19 has both a mechanical and an electrical function. The very same counts for the outer connecting section 18, which may have both a mechanical and an electrical function, too. However, it is also possible, that the arm 17*a* comprises an additional outer contacting pad 23 (drawn with a dashed line).

FIG. 8 also shows that two arms 17*a* are connected by a bridge 24 thus forming the first arm sub arrangement 15*a*. Again, the bridge 24 can have both a mechanical and an electrical function.

In the example of FIG. 8, the inner contacting pad 22 is arranged within the first bow 20. In this way, the area of the inner contacting pad 22 is relatively large so that the coil arrangement 6 can be connected to the arm 17*a* reliably (e.g. by soldering, welding or gluing). Nevertheless, just little space is needed in total for the connection of the magnet system 8 and the coil arrangement 6. In other words, the inner contacting pad 22 is no cause for an increased air gap between the magnet system 8 and the coil arrangement 6, and hence efficiency and power of the speaker 5 are comparably high. Beneficially, a distance d between the first bow 20 and the inner contacting pad 22 is less than 0.2 mm. It should be noted that the very same technical teaching with the very same advantages can be applied to the outer contacting pad 23. Beneficially, it can be arranged within the second bow 21, and beneficially a distance d between the second bow 21 and the outer contacting pad 23 can be less than 0.2 mm. Apart of the advantages disclosed above, the inner contacting pad 22' may also be arranged out of the first bow 20 (drawn with a dashed line).

It should be noted at this point that the meander is not necessarily "round", but may also comprise, be made up or be approximated by straight segments as this is the case in FIG. 8. In this example, the straight segments are concatenated by round bows 20, 21, however, the straight segments can also be concatenated by corners. Instead of the straight segments of FIG. 8 also round shapes may be used. In other words, the term "meander" is to be interpreted widely in this disclosure.

In the example of FIG. 8 two arms 17*a* are connected by a bridge 24, but this is no necessary condition. The coil arrangement 6 can be connected to the magnet system 8 also by a number of separate arms 17*a*. An example of such a separate arm 17*a* is depicted in FIG. 9.

Figure 9:
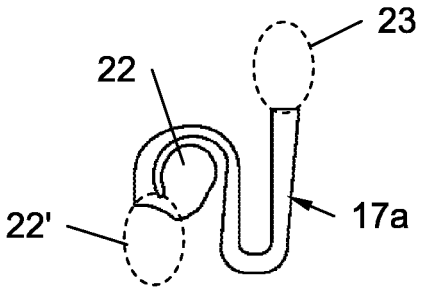
FIG. 9 shows an example for a separate arm in top view.
Figure 10:
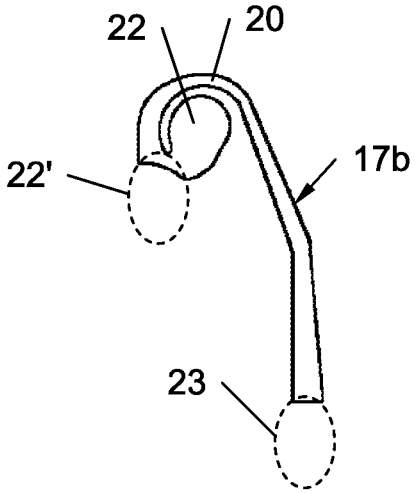
FIG. 10 shows an example of an arm, which is shaped like a bow.

In the examples of FIGS. 8 and 9, the arms 17*a* have the shape of a meander. This is no necessary condition, and the arm 17*a* may also be shaped differently. FIG. 10 shows an example of an arm 17*b*, which has just one bow 20 or which is shaped like a bow when viewed into a direction parallel to the coil axis A. It should be noted at this point that the bow is not necessarily "round", but may also comprise, be made up or be approximated by straight segments as this is the case in FIG. 10. In this example a round bow 20 is adjacent to a straight segment, but there is also a corner between said straight segment and another segment. In other words, the term "bow" is to be interpreted widely in this disclosure. It should be noted that length or angle of the bow 20 can also be lower and so the arm 17*b* can be more shaped like an "L" when viewed into a direction parallel to the coil axis A.

The technical teaching which has been disclosed above in the context of FIGS. 8 and 9 equally applies to the example shown in FIG. 10, in particular in view of the existence and arrangement of contacting pads 22, 22' and 23, in view of the mechanical and/or electrical function of the parts of the arm 17*b* and in view of the bridge 24. In particular, a contacting pad 22, 22' and 23 can be arranged within the bow 20 or within the corner of an L-shape.

Generally, the arms 17*a*, 17*b* can be made of a single metal with a fatigue strength of at least 370 $N/mm^2$ or an ultimate tensile strength of at least 1100 $N/mm^2$. However, it is also possible, that the arms 17*a*, 17*b* are made of a metal core with a fatigue strength of at least 370 $N/mm^2$ or an ultimate tensile strength of at least 1100 $N/mm^2$, which at least partly (or entirely) is coated with a coating structure having at least one coating metal layer consisting of a different material than the metal core.

Figure 11:
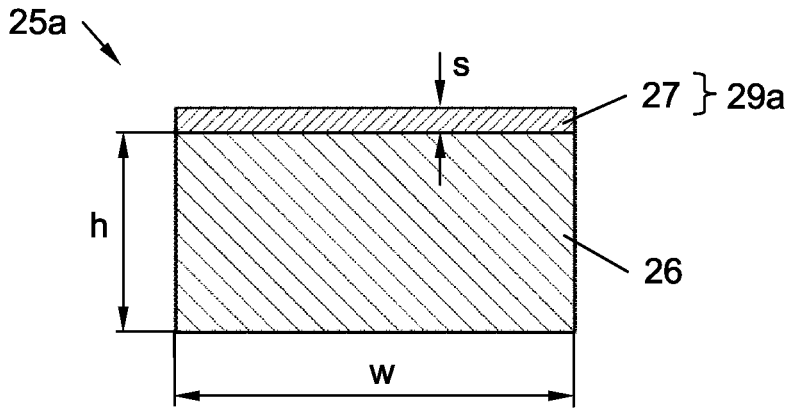
FIG. 11 shows a first cross section of an arm with a metal core and with a coating metal layer on top.

FIGS. 11 to 15 now show various examples for cross sections of the arms 17*a*, 17*b* with a metal core and a coating structure. In detail, FIG. 11 shows a first cross section 25*a* of an arm 17*a*, 17*b* with a metal core 26 with a coating metal layer 27 on top, the material of which is different to the material of the metal core 26. The coating metal layer 27 forms a coating structure 29*a*.

As can be seen, the cross section of the metal core 26 is rectangular. It is advantageous if a ratio between the width w of the cross section of the metal core 26, which is its extension in a direction perpendicular to the coil axis A, divided by the height h of the cross section of the metal core 26, which is its extension in a direction parallel to the coil axis A, is above 3.0. Furthermore, it is beneficial if the width w of the cross section of the metal core 26 is in a range of 200 to 800 μm and/or the height h of the cross section of the metal core 26 is in a range of 10 to 100 μm. Further on, the thickness s of the coating metal layer 27, which is its extension in a direction parallel to the coil axis A, beneficially is in a range of 0.5 to 10 μm. It is also advantageous if a ratio of a stiffness of the arm arrangement 14 to a stiffness of the membrane 2 in direction of the coil axis A is below 2.7 and/or if a ratio of a stiffness of the arm arrangement 14 to a stiffness of the membrane 2 in direction transverse to the coil axis a is below 5.0.

All these measures contribute to a comparably low stiffness of the arms 17*a*, 17*b* in excursion direction C and a comparably high stiffness of the arms 17*a*, 17*b* in a lateral direction (perpendicular to the excursion direction C) in a range which is favorable in view of high power and high efficiency of the speaker 5 as well as low rocking tendency. The above measures particular relate to "small" speakers 5.

Small speakers in the context of this disclosure generally are speakers 5 with a membrane 2, which has an area of less than 600 $mm^2$ when viewed in a direction parallel to the coil axis A and/or speakers 5 with a back volume F, which is in a range from 200 $mm^3$ to 2 $cm^3$. The back volume F generally is the volume "behind" the membrane 2 and may be the volume enclosed by a housing of the speaker 5, enclosed by other parts of the speaker 5 or enclosed by a housing of a device, which the speaker 5 is built into (e.g. a mobile phone).

It should be noted that the width w and/or height h of the cross section of the metal core 26 are not necessarily fixed numbers, but may vary over the length or longitudinal extension of the arms 17*a*, 17*b*. In this way, the shape, into which an arm 17*a*, 17*b* is transformed when it is deflected, can be controlled or influenced. The longitudinal extension of an arm 17*a*, 17*b* is defined by those line, on which the center points of the (all) cross sections of the arms 17*a*, 17*b* are located.

Figure 12:
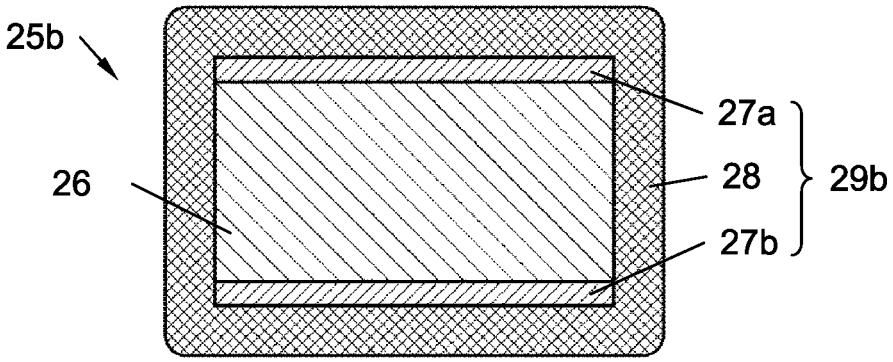
FIG. 12 shows a second cross section of an arm with two coating metal layers and an outer coating layer.

FIG. 12 shows a second cross section 25*b* of an arm 17*a*, 17*b* with a metal core 26 with coating metal layers 27*a*, 27*b* on the top and on the bottom. Again the material of the metal core 26 is different to that of the coating metal layers 27*a*, 27*b*. Furthermore, the second cross section 25*b* comprises an outer coating layer 28 which in this example entirely covers the structure made up of the metal core 26 and the coating metal layers 27*a*, 27*b*. The coating metal layers 27*a*, 27*b* together with the outer coating layer 28 forms a coating structure 29*b* having coating metal layers 27*a*, 27*b* consisting of a different material than the metal core 26.

Figure 13:
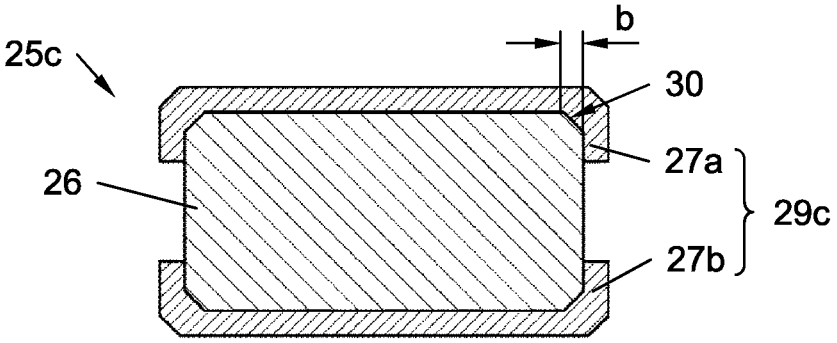
FIG. 13 shows a third cross section of an arm, wherein the metal core comprises chamfers.

FIG. 13 shows a third cross section 25*c* of an arm 17*a*, 17*b* with a metal core 26 with a coating metal layers 27*a*, 27*b* on the top and on the bottom, wherein the material of the metal core 26 is different to that of the coating metal layers 27*a*, 27*b*. The coating metal layers 27*a*, 27*b* form a coating structure 29*c*. In this example, the cross section of the metal core 26 has chamfers 30, wherein the smallest length b of a side of a rectangular triangle defining the chamfer is 3 nm. For example, the chamfer 30 can be a chamfer 45°×3 nm. By use of chamfers 30, coating the metal core 26 with the coating metal layers 27*a*, 27*b* can be eased.

Figure 14:
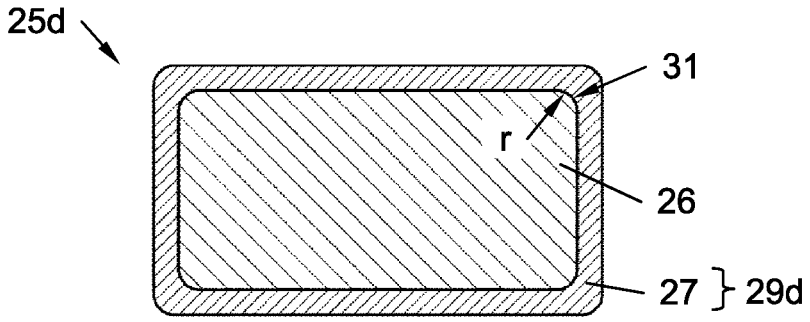
FIG. 14 shows a fourth cross section of an arm, wherein the metal core comprises rounded corners.

FIG. 14 shows a fourth cross section 25*d* of an arm 17*a*, 17*b* with a metal core 26 with a coating metal layer 27 which entirely covers the metal core 26. Again the material of the metal core 26 is different to that of the coating metal layer 27. The coating metal layer 27 forms a coating structure 29*d*. In this example, the cross section of the metal core 26 has rounded corners 31 with a radius r of at least 3 nm. By use of rounded corners 31, coating the metal core 26 with the coating metal layers 27*a*, 27*b* can be eased as well.

Figure 15:
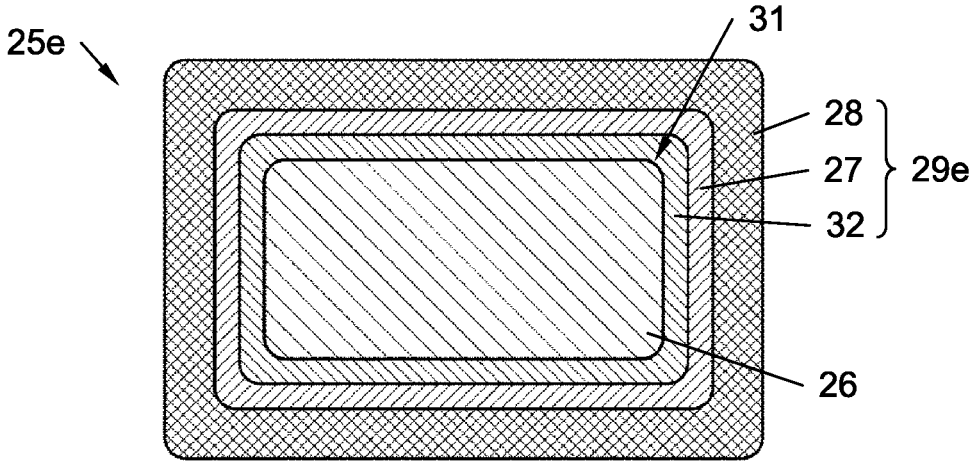
FIG. 15 shows a fifth cross section of an arm with two different coating metal layers.

FIG. 15 shows a fifth cross section 25*e* of an arm 17*a*, 17*b* with a metal core 26 with a first coating metal layer 27 and a different second coating metal layer 32 which is located between the metal core 26 and the first coating metal layer 27. In addition, the fifth cross section 25*e* comprises an outer coating layer 28, which in this example entirely covers the structure made up of the metal core 26, the first coating metal layer 27 and the second coating metal layer 32. The first coating metal layer 27 and the second coating metal layer 32 together with the outer coating layer 28 form a coating structure 29*e*. Again, the metal core 26 has rounded corners 31.

It should be noted that the arrangements of metal cores 26, first coating metal layers 27, 27*a*, 27*b*, second coating metal layers 32, outer coating layers 28, chamfers 30 and rounded corners 31 shown in the FIGS. 11 to 15 are just exemplary, and the features of the examples in principle are interchangeable. For example, the first cross section 25*a* may have chamfers 30 and/or rounded corners 31, or the fifth cross section 25 may be made without rounded corners 31. The fifth cross section 25 may be made without an outer coating layer 28, and the fourth cross section 25*d* can be made with an outer coating layer 28 and so on.

In general and applicable to all examples of FIGS. 11 to 15 it is advantageous if the metal core 26 is made of or comprises steel, brass, bronze, molybdenum or tungsten. In this way, the metal core 26 is comparably robust and can withstand the comparably high alternating mechanical load, which is caused by an excursion of the electrodynamic actuator 1*a* (i.e. by a relative movement between the coil arrangement 6 and the magnet system 8). This is particularly true if the metal core 26 is made of a stainless steel, which makes the metal core 26 comparably robust. In a very advantageous embodiment, the metal core 26 is made of a cold-rolled stainless steel with a fatigue strength in a range of 370 to 670 $N/mm^2$ or an ultimate tensile strength in a range of 1100 to 2000 $N/mm^2$. Beneficially, austenitic stainless steel can be used for the metal core 26, in particular stainless steel 1.4404. During evaluations this material turned out to particularly fit well to the demands in actuator design. Austenitic stainless steels have a high share of austenite and as such are non-ferromagnetic or low-ferromagnetic. Accordingly no or just low (unwanted) forces are induced into the metal core 26 when it moves in the magnetic field in the air gap of the magnet system 8. Such forces could shift the (dynamic) idle position of the electrodynamic actuator 1*a* . . . 1*c* and deteriorate its characteristics. Moreover, austenitic stainless steel does not or does not substantially magnetically bridge the air gap of the magnet system 8. In other words, a metal core 26 does not form a magnetic short circuit in the magnet system 8. Furthermore, stainless steel, in addition to its characteristics presented before, provides the advantage that it is resistant against oxidation.

It should be noted that FIGS. 11 to 15 are disclosed in the context of a metal core 26 with a coating structure 29*a* . . . 29*e* having at least one coating metal layer 27, 27*a*, 27*b*, 32. However, the characteristics of the metal core 26 can also applied to the arm 17*a*, 17*b* as such if there is no such coating structure 29*a* . . . 29*e* having at least one coating metal layer 27, 27*a*, 27*b*, 32. That means that the metal core 26 in fact is the arm 17*a*, 17*b* in such case and the term "metal core 26" can be substituted by the term "arm 17*a*, 17*b*" where it is applicable. In particular this means that the cross section of the arm 17*a*, 17*b* can be rectangular. It is also advantageous if a ratio between the width w of the cross section of the arm 17*a*, 17*b*, which is its extension in a direction perpendicular to the coil axis A, divided by the height h of the cross section of the arm 17*a*, 17*b*, which is its extension in a direction parallel to the coil axis A, is above 3.0. Furthermore, it is beneficial if the width w of the cross section of the arm 17*a*, 17*b* is in a range of 200 to 800 μm and/or the height h of the cross section of the arm 17*a*, 17*b* is in a range of 10 to 100 μm. The width w and/or height h of the cross section of the arm 17*a*, 17*b* may vary over the length or longitudinal extension of the arms 17*a*, 17*b*. The cross section of the arm 17*a*, 17*b* can have chamfers 30 or rounded corners 31. The arm 17*a*, 17*b* furthermore can be made of or comprises steel, brass, bronze, molybdenum or tungsten. Advantageously it is made of stainless steel, in particular it is made of a cold-rolled stainless steel with a fatigue strength in a range of 370 to 670 $N/mm^2$ or an ultimate tensile strength in a range of 1100 to 2000 $N/mm^2$. In particular stainless steel 1.4404 can be used for this reason.

In general and applicable to all examples of FIGS. 11 to 15 it is furthermore advantageous if the first coating metal layer 27, 27*a*, 27*b* comprises or consists of copper, silver, gold or aluminum. The second coating metal layer 32 may comprise or consist of nickel, titanium or chromium. In that, the first coating metal layer 27, 27*a*, 27*b* and/or the second coating metal layer 32 has a very good electrical conductivity and in case of gold (and to a less extent in case of silver) is resistant against oxidation.

Generally it is of advantage if the first coating metal layer 27, 27*a*, 27*b* and the second coating metal layer 32 are chosen from the pairs of Cu/Ni, Au/Ni, Ag/Ni, Al/Ti, Al/Cr, wherein the first cited metal refers to the first coating metal layer 27, 27*a*, 27*b* and the second cited metal refers to the second coating metal layer 32 and wherein said metals are the main components of the respective coating metal layers 27, 27*a*, 27*b*, 32 or the coating metal layers 27, 27*a*, 27*b*, 32 consist of the respective metals. In this way, second coating metal layer 32 can be used as a bonding agent or a bonding intermediate layer for the first coating metal layer 27, 27*a*, 27*b* so that a good adhesive strength can be obtained.

Generally, it is furthermore advantageous if the outer coating layer 28 is made of a polymer (e.g. thermoplastics, thermosetting plastic, elastomer, rubber). In this way, non oxidation resistant materials can be protected from oxidation.

Generally it is also of advantage if the material of the first coating metal layer 27, 27*a*, 27*b* and/or the second coating metal layer 32 has a higher or better electrical conductivity than the material of the metal core 26. In this way, a low ohmic resistance can be obtained by use of the first coating metal layer 27, 27*a*, 27*b* and/or the second coating metal layer 32.

In the above context it is particularly advantageous if the material of the first coating metal layer 27, 27*a*, 27*b* and/or the second coating metal layer 32 has a higher or better electrical conductivity than the material of the metal core 26, but a worse bending fatigue strength or ultimate tensile strength. That means that the metal core 26 mainly takes the mechanical load whereas the first coating metal layer 27, 27*a*, 27*b* and/or the second coating metal layer 32 mainly take the electrical load or mainly has the electrical function.

In yet another advantageous embodiment, the bending stress within the metal core 26 is below its fatigue strength, whereas the bending stress within the first coating metal layer 27, 27*a*, 27*b* and/or the second coating metal layer 32 is above its fatigue strength, or the bending stress within the metal core 26 is below its ultimate tensile strength, whereas the bending stress within the first coating metal layer 27, 27*a*, 27*b* and/or the second coating metal layer 32 is above its bending ultimate tensile strength when the excursion of the coil arrangement 6 relative to the magnet system 8 in a direction parallel to the coil axis A reaches its nominal maximum of the electrodynamic actuator 1*a* or is above 0.4 mm with respect to the idle position of the coil arrangement 6. The excursion of the coil arrangement 6 with respect to its idle position also equals its amplitude.

Figure 16:
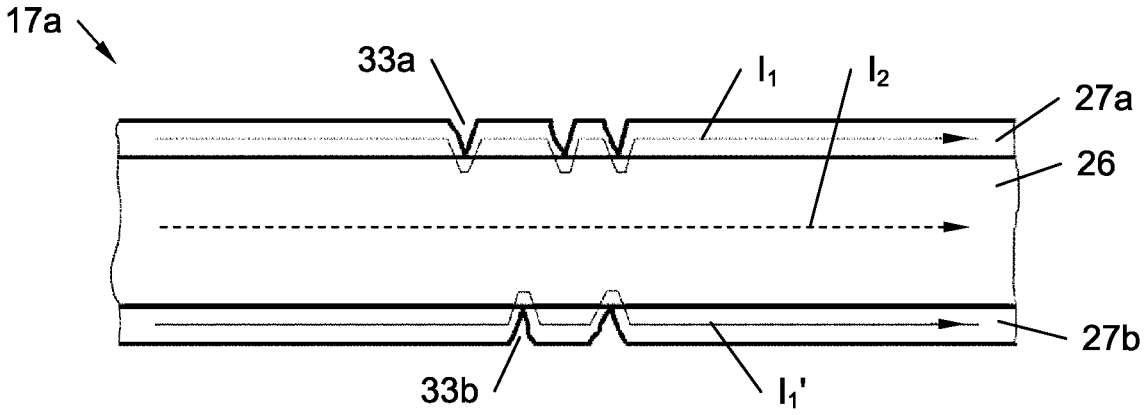
FIG. 16 shows a sectional side view of an arm with cracks or grooves in the coating metal layers.

In other words this means that the first coating metal layer 27, 27*a*, 27*b* and/or the second coating metal layer 32 will break when the electrodynamic actuator 1*a* is operated or will break by default or by design. Surprisingly, that does not have much influence on the function of the arms 17*a*, 17*b* as investigations have been shown. FIG. 16, which shows a (non-hatched) cross sectional side view of an arm 17*a* (exchangeable with the arm 17*b*), illustrates why.

In detail, the arm 17*a* has a metal core 26 with coating metal layers 27*a*, 27*b* on the top and on the bottom. The materials are chosen in a way that the first coating metal layers 27*a*, 27*b* have a higher or better electrical conductivity than the metal core 26, but a lower or worse bending fatigue strength or ultimate tensile strength. As said, the bending fatigue strength or ultimate tensile strength of the first coating metal layers 27*a*, 27*b* is so low that it breaks when the electrodynamic actuator 1*a* is operated. Accordingly, cracks or grooves 33*a*, 33*b* occur over time as this is depicted in FIG. 16. One would come to the conclusion that the ohmic resistance for this reason would rise up to a level that the performance of the electrodynamic actuator 1*a* or the speaker 5 is substantially deteriorated or is even inacceptable. In contrast, the cracks or grooves 33*a*, 33*b* have nearly no influence on said performance because the currents $I_1$, $I_1'$, which usually flow through the first coating metal layers 27*a*, 27*b* locally changes over to the metal core 26, which draws the current $I_2$. So the currents $I_1$, $I_1'$ are not interrupted as if it is the case if a plastic substrate is used for the first coating metal layers 27*a*, 27*b*, but they have a slightly higher ohmic resistance for a short distance. In turn, this configuration provides both an outstanding mechanical resistance based on the characteristics of the material of the metal core 26 and outstanding electrical conductivity based on the characteristics of the first coating metal layers 27*a*, 27*b*.

Although cracks or grooves 33*a*, 33*b* are accepted, the overall electrical conductivity is much better than it is if just the material of the metal core 26 is used for the arms 17*a*, 17*b* (what would be the common approach of avoiding breakage). At the same time, the overall mechanical performance is much better than if just the material of the first coating metal layers 27*a*, 27*b* would be used for the arms 17*a*, 17*b* (what would be the common approach of providing best electrical conductivity). So, the overall performance of the proposed configuration goes beyond that what a skilled in the art had expected.

Figure 17:
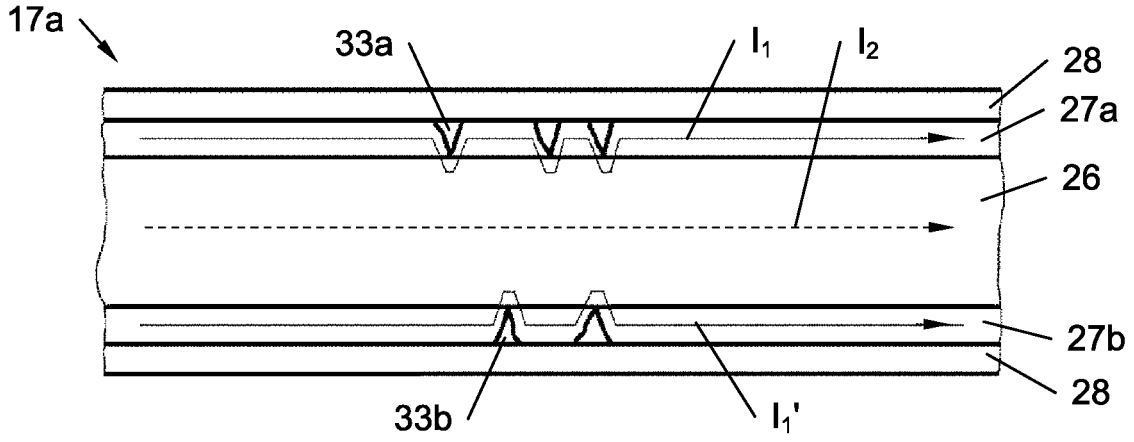
FIG. 17 shows a configuration similar to that of FIG. 16, but with an outer coating layer.

In the above context it is particularly advantageous, if the proposed configuration is coated with an outer coating layer 28 made of a polymer (e.g. thermoplastics, thermosetting plastic, elastomer, rubber) like this is shown in FIG. 17. In this way, not only oxidation is avoided, but chipping or peeling of the first coating metal layer 27, 27*a*, 27*b* and/or the second coating metal layer 32 can be hindered, or at least parts of the first coating metal layer 27, 27*a*, 27*b* and/or the second coating metal layer 32 chipped or peeled off can be hold back. In other words, the outer coating layer 28 avoids that parts of the first coating metal layer 27, 27*a*, 27*b* and/or the second coating metal layer 32 spread in an uncontrolled manner what could cause short circuits and malfunction of the electrodynamic actuator 1*a* and of the device, which the electrodynamic actuator 1*a* is built into.

In general, it is of advantage if the coating structure 29*a* . . . 29*e* (and in particular its outer coating layer 28) is arranged on the metal core 26 over a length of at least 90% of the longitudinal extension of an arm 17*a*, 17*b*. In this way, uniform characteristics for nearly the whole arm 17*a*, 17*b* can be obtained. However, the coating structure 29*a* . . . 29*e* (e.g. its outer coating layer 28) can be omitted in particular in the outer connecting section 18, the inner connecting section 19, the inner contacting pad 22, 22', the outer contacting pad 23 or areas nearby those arm sections.

Figure 18:
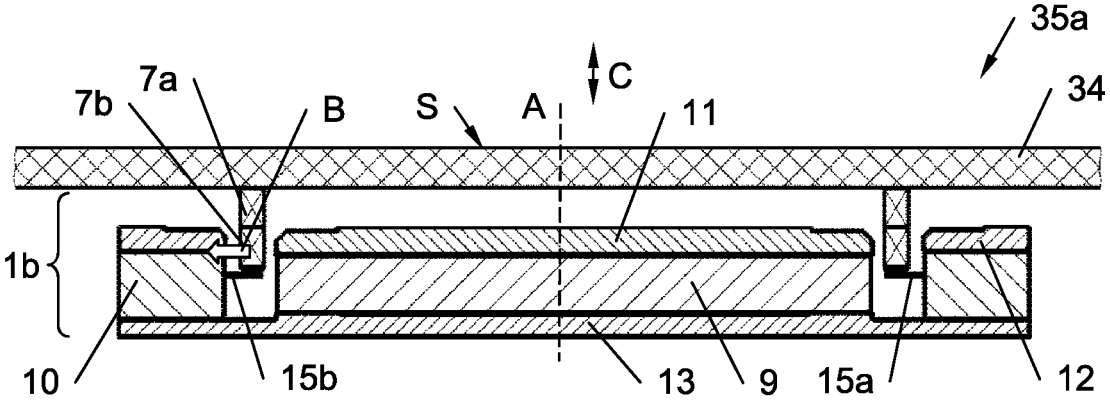
FIG. 18 shows a sectional view of a first example of an electrodynamic transducer and FIG. 19 shows a sectional view of a second example of an electrodynamic transducer with a movable and a fixed part of the magnet system.
Figure 19:
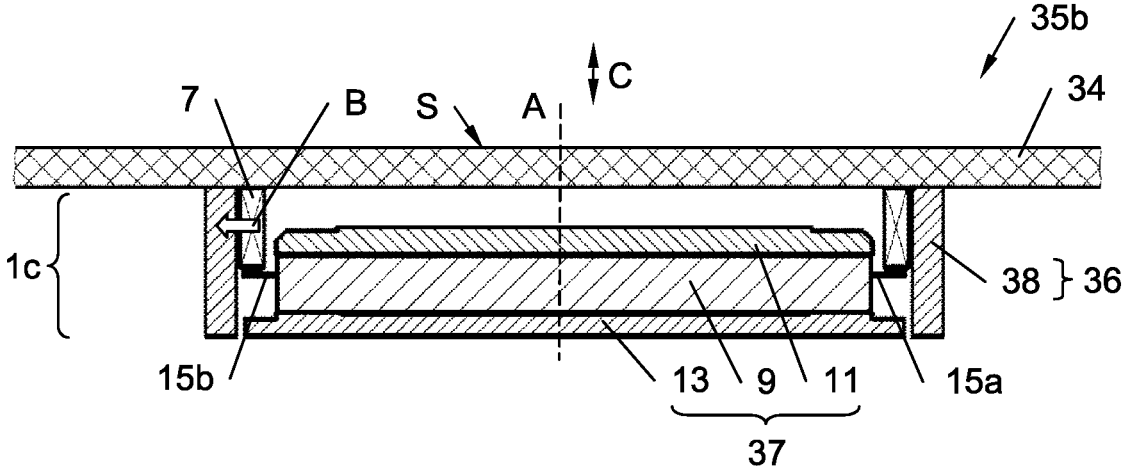

In the examples shown in FIGS. 1 to 7, the electromagnetic actuator 1*a* is connected to a membrane 2 thus forming a speaker 5. This however is no necessary condition, but an electromagnetic actuator 1*b*, 1*c* can also be connected to a plate like structure 34 like this is shown in FIGS. 18 and 19. In this way, electrodynamic transducers 35*a*, 35*b* are formed. In detail, the plate like structure 34 comprises a sound emanating surface S and a backside opposite to the sound emanating surface S. The electrodynamic actuator 1*b*, 1*c* is connected to its backside. For this reason, the coil arrangement 6 or the magnet system 8 comprises a flat mounting surface, which is intended to be connected to the backside of the plate like structure 34, wherein said backside is oriented perpendicularly to the coil axis A.

FIG. 18 shows a first example for such an electrodynamic transducers 35*a*. In fact, the electromagnetic actuator 1*b* looks very much like the electromagnetic actuator 1*a*, which is used for the speaker 5. In contrast, the magnet system 8 is not connected to the plate like structure 34, but it may freely move in relation to the coil arrangement 6. In the example of FIG. 18 a frame 16 is omitted. Nonetheless, the electrodynamic transducer 35*a* can also comprise a frame 16 as the case may be.

FIG. 19 shows an example of an electrodynamic transducer 35*b*, which is similar to the electrodynamic transducer 35*a* of FIG. 18. The main difference is that the magnet system 8 comprises a fixed part 36 and a movable part 37. The fixed part 36 in this example is formed by an outer ring 38 from soft iron, and the movable part 37 is formed by the center magnet 9, the center top plate 11 and the bottom plate 13. Another difference is that there is just one voice coil 7 instead of two. Finally, the arm sub arrangements 15*a*, 15*b* are arranged on the inner side of the voice coil 7 and connect the same to the movable part 37 of the magnet system 8. Thus the movable part 37 may freely move relative to the voice coil 7.

In general, as said, an electromagnetic actuator 1*b*, 1*c* together with the plate like structure 34 forms an electrodynamic transducer 35*a*, 35*b*. For example, the plate like structure can be a passive structure, for example a part of a housing of a device, which the electromagnetic actuator 1*b*, 1*c* is built into. However, the plate like structure can also have a special function itself. For example, if the plate like structure 34 is embodied as a display, the electrodynamic actuator 1*b*, 1*c* together with the display forms an output device (for both audio and video data).

In contrast to a membrane 2, a plate like structure 34 in the sense of this disclosure has no dedicated flexible part like the membrane 2 has. Accordingly, there is no extreme separation of deflection and piston movement like it is the case for the flexible membrane part 3 (deflection) and a rigid membrane part 4 (piston movement). Instead, sound generation is done via deflection of the whole plate like structure 34. When a plate like structure 34 is used, moreover either the coil arrangement 6 or the magnet system 8 (or at least a part thereof) is connected to the plate like structure 34 or fixedly arranged in relation to the plate like structure 34. A force applied to the plate like structure 34 may be generated by the inertia of the part of the electrodynamic actuator 1*b*, 1*c* which is moved in relation to the plate like structure 34 (which is the magnet system 8 in case of FIG. 18 and the movable part 37 of the magnet system 8 in case of FIG. 19) or because the part of the electrodynamic actuator 1*b*, 1*c* which is moved in relation to the plate like structure 34 is fixed to another part (e.g. to a housing of a device, which the electrodynamic actuator 1*b*, 1*c* is built into).

It should also be noted that the arm arrangement 14 can be seen as a spring arrangement in case that the electrodynamic actuator 1*b*, 1*c* is connected to a backside of a plate like structure 34 and can be seen as a suspension system in case that the electrodynamic actuator 1*a* is connected to a backside of a membrane 2.

In general, a speaker 5 or an electrodynamic transducer 35*a*, 35*b* (or output device) of the kind disclosed hereinbefore produces an average sound pressure level of at least 50 dB_SPL in a frequency range from 100 Hz to 15 kHz measured in an orthogonal distance of 10 cm from the sound emanating surface S. In particular, the above average sound pressure level is measured at 1 W electrical power more particularly at the nominal impedance.

It should be noted that the invention is not limited to the above-mentioned embodiments and exemplary working examples. Further developments, modifications and combinations are also within the scope of the patent claims and are placed in the possession of the person skilled in the art from the above disclosure. Accordingly, the techniques and structures described and illustrated herein should be understood to be illustrative and exemplary, and not limiting upon the scope of the present invention. The scope of the present invention is defined by the appended claims, including known equivalents and unforeseeable equivalents at the time of filing of this application. Although numerous embodiments of this invention have been described above with a certain degree of particularity, those skilled in the art could make numerous alterations to the disclosed embodiments without departing from the spirit or scope of this disclosure.

It should also be noted that the Figs. are not necessarily drawn to scale and the depicted parts may be larger or smaller in reality.

LIST OF REFERENCES

1*a* . . . 1*c* electrodynamic actuator
2 membrane
3 flexible membrane part
4 rigid membrane part
5 speaker
6 coil arrangement
7, 7*a*, 7*b* voice coil
8 magnet system
9 center magnet
10 . . . 10*d* outer magnet
11 center top plate
12 outer top plate
13 bottom plate
14 arm arrangement
15*a*, 15*b* arm sub arrangement
16 frame
17*a*, 17*b* arm
18 outer connecting section
19 inner connecting section
20 first bow
21 second bow
22, 22' inner contacting pad

23 outer contacting pad
24 bridge
25*a* . . . 25*e* cross section
26 metal core
27 . . . 27*b* (first) coating metal layer
28 outer coating layer
29*a* . . . 29*e* coating structure
30 chamfer
31 rounded corner
32 second coating metal layer
33*a*, 33*b* crack/groove
34 plate like structure
35*a*, 35*b* electrodynamic transducer
36 fixed part of magnet system
37 movable part of magnet system
38 outer ring
b chamfer length
d distance between contacting pad and bow or corner
h height
r radius
s thickness
w width
A coil axis
B magnetic field
C excursion direction
F back volume
$I_1$, $I_1'$ current in (first) coating metal layer
$I_2$ current in metal core
S sound emanating surface

What is claimed is:

1. Electrodynamic actuator, which is designed to be connected to a backside of a plate structure or membrane opposite to a sound emanating surface of the plate structure or the membrane and which comprises at least one voice coil, which has an electrical conductor in a shape of loops running around a coil axis in a loop section, and a magnet system being designed to generate a magnetic field transverse to the electrical conductor in the loop section and an arm arrangement of a plurality of arms connecting the at least one voice coil and a) the magnet system and allowing a relative movement between the at least one voice coil and said magnet system in an excursion direction parallel to the coil axis or b) a movable part of the magnet system and allowing a relative movement between the at least one voice coil and said movable part of the magnet system in an excursion direction parallel to the coil axis, wherein the plurality of arms are made of a metal with a fatigue strength of at least 370 N/mm$^2$ or an ultimate tensile strength of at least 1100 N/mm$^2$.

2. Electrodynamic actuator as claimed in claim 1, characterized in that the plurality of arms are made of a metal core, which at least partly is coated with a coating structure having at least one coating metal layer consisting of a different material than the metal core, wherein the metal core has a fatigue strength of at least 370 N/mm$^2$ or an ultimate tensile strength of at least 1100 N/mm$^2$.

3. Electrodynamic actuator as claimed in claim 1, characterized in that the plurality of arms and in particular a metal core is made of or comprises steel, brass, bronze, molybdenum or tungsten.

4. Electrodynamic actuator as claimed in claim 3, characterized in that the plurality of arms and in particular the metal core is made of a stainless steel.

5. Electrodynamic actuator as claimed in claim 4, characterized in that the plurality of arms and in particular the metal core is made of a cold-rolled stainless steel with a fatigue strength in a range of 370 to 670 N/mm$^2$ or an ultimate tensile strength in a range of 1100 to 2000 N/mm$^2$.

6. Electrodynamic actuator as claimed in claim 1, characterized in that a cross section of the plurality of arms and in particular a metal core is rectangular wherein a ratio between a width of the cross section, which is its extension in a direction perpendicular to the coil axis, divided by a height of the cross section, which is its extension in a direction parallel to the coil axis, is above 3.0.

7. Electrodynamic actuator as claimed in claim 1, characterized in that a width of a cross section of the plurality of arms and in particular a metal core is in a range of 200 to 800 μm.

8. Electrodynamic actuator as claimed in claim 1, characterized in that a height of the cross section of the plurality of arms and in particular a metal core is in a range of 10 to 100 μm.

9. Electrodynamic actuator as claimed in claim 1, characterized in that the width and/or height of a cross section of the plurality of arms and in particular a metal core varies over a length of the plurality of arms.

10. Electrodynamic actuator as claimed in claim 1, characterized in that a cross section of the plurality of arms and in particular a metal core has rounded corners with a radius of at least 3 μm or chamfers, wherein a smallest length of a side of a rectangular triangle defining a chamfer is at least 3 μm.

11. Electrodynamic actuator as claimed in claim 1, characterized in that a thickness (s) of the at least one coating metal layer is in a range of 0.5 to 10 μm, wherein the thickness (s) of the at least one coating metal layer is its extension in a direction parallel to the coil axis in case that a contacting area to a metal core lies in a plane perpendicular to the coil axis and its extension in a direction perpendicular to the coil axis in case that a contacting area to the metal core lies in a plane parallel to the coil axis.

12. Electrodynamic actuator as claimed in claim 1, characterized in that a material of at least one coating metal layer has a higher electrical conductivity than a material of a metal core, but a lower bending fatigue strength or ultimate tensile strength.

13. Electrodynamic actuator as claimed in claim 1, characterized in that a bending stress within a metal core is below its fatigue strength, whereas a bending stress within at least one coating metal layer is above its fatigue strength, or a bending stress within a metal core is below its ultimate tensile strength, whereas the bending stress within the at least one coating metal layer is above its bending ultimate tensile strength when the excursion of the at least one voice coil relative to the magnet system or its movable part in a direction parallel to the coil axis reaches its nominal maximum of the electrodynamic actuator or is above 0.4 mm with respect to an idle position of the at least one voice coil.

14. Electrodynamic actuator as claimed in claim 1, characterized in that at least one coating metal layer comprises or consists of copper, silver, gold or aluminum.

15. Electrodynamic actuator as claimed in claim 1, characterized in that at least some of the plurality of arms are electrically connected to the at least one voice coil.

16. Electrodynamic actuator as claimed in claim 1, characterized in that the plurality of arms are shaped like a bow, like a meander or L-shaped when viewed into a direction parallel to the coil axis.

17. Electrodynamic actuator as claimed in claim 16, characterized in that the plurality of arms are shaped like a bow or L-shaped when viewed into a direction parallel to the coil axis, wherein at least a contacting pad of the arms is arranged within the bow or within a corner of the L-shape.

18. Electrodynamic actuator as claimed in claim 17, characterized in that a distance between the bow or corner and the at least one contacting pad is less than 0.2 mm.

19. Electrodynamic actuator as claimed in claim 16, characterized in that the arms are shaped like a meander when viewed into a direction parallel to the coil axis, wherein the meander has two bows at most and wherein at least one contacting pad of the plurality of arms is arranged within at least one bow of the two bows.

20. Electrodynamic actuator as claimed in claim 1, characterized in that a coating structure is arranged on a metal core over a length of at least 90% of a longitudinal extension of at least one arm of the plurality of arms.

21. Electrodynamic actuator as claimed in claim 1, characterized in that a diameter of a metal core of the electrical conductor of the at least one voice coil is ≤110 μm.

22. Speaker, characterized by the electrodynamic actuator as claimed in claim 1 and the membrane, which is fixed to the at least one coil and to the magnet system.

23. Speaker as claimed in claim 22, characterized in that a ratio of a stiffness of the plurality of arms arrangement to a stiffness of the membrane in direction of the coil axis is below 2.7.

24. Speaker as claimed in claim 22, characterized in that a ratio of a stiffness of the plurality of arms arrangement to a stiffness of the membrane in direction transverse to the coil axis is below 5.0.

25. Speaker as claimed in claim 22, characterized in that an area of the membrane seen in a direction parallel to the coil axis is smaller than 600 $mm^2$ and/or a back volume of the speaker is in a range from 200 $mm^3$ to 2 $cm^3$.

* * * * *